United States Patent [19]

Nishikawa et al.

[11] 4,394,427

[45] Jul. 19, 1983

[54] ELECTROPHOTOGRAPHIC SENSITIZING SCREEN WITH PERIPHERALLY CLOGGED APERTURES

[75] Inventors: Masaji Nishikawa; Norio Amemiya; Tadahiro Yasuda; Shigeru Nakayama, all of Hachioji, Japan

[73] Assignee: Olympus Optical Company Limited, Tokyo, Japan

[21] Appl. No.: 247,783

[22] Filed: Mar. 26, 1981

Related U.S. Application Data

[65] Continuation of Ser. No. 98,315, Nov. 28, 1979, abandoned.

[30] Foreign Application Priority Data

| | | | |
|---|---|---|---|
| Jun. 24, 1977 | [JP] | Japan | 52-74969 |
| Jun. 24, 1977 | [JP] | Japan | 52-74970 |
| Jun. 24, 1977 | [JP] | Japan | 52-74971 |
| Jun. 24, 1977 | [JP] | Japan | 52-74972 |
| Jun. 24, 1977 | [JP] | Japan | 52-74973 |

[51] Int. Cl.[3] ..... G03G 5/04

[52] U.S. Cl. ..... 430/68; 355/3 SC; 245/10

[58] Field of Search ..... 430/53, 68; 355/3 SC; 245/10; 313/94, 348, 355; 174/72 B

[56] References Cited

U.S. PATENT DOCUMENTS

| | | | |
|---|---|---|---|
| 3,216,677 | 11/1965 | Hofmann | 245/10 |
| 3,425,900 | 2/1969 | Purdy | 245/10 X |
| 3,628,095 | 12/1971 | Schwartz | 174/72 B X |
| 3,713,734 | 1/1973 | Crane et al. | 430/68 X |
| 3,898,085 | 8/1975 | Suzuki et al. | 430/68 |
| 4,046,466 | 9/1977 | Ando et al. | 430/68 X |
| 4,083,720 | 4/1978 | Nakatsubo et al. | 430/68 X |
| 4,092,160 | 5/1978 | Jackson et al. | 430/68 X |
| 4,157,260 | 6/1979 | Kimura et al. | 430/68 |

*Primary Examiner*—Roland E. Martin, Jr

*Attorney, Agent, or Firm*—Fleit & Jacobson

[57] ABSTRACT

An electrophotographic sensitizing screen having a great number of apertures, wherein at least an insulating layer and a conductive layer are successively formed on a conductive mesh, is disclosed. These apertures are regularly arranged at such an angle as not to produce moire fringes with respect to a light image projected on the screen.

6 Claims, 10 Drawing Figures

FIG. 1
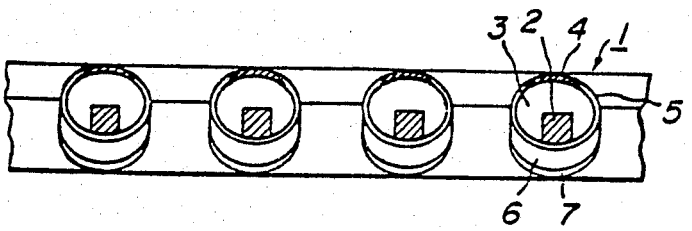
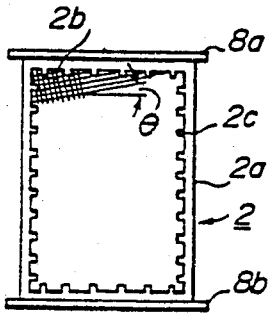
FIG. 2
FIG. 3
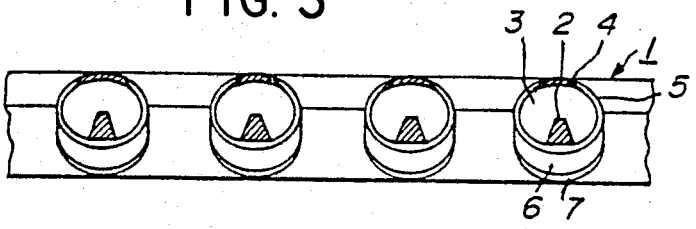

Light Image Projection

ELECTROPHOTOGRAPHIC SENSITIZING SCREEN WITH PERIPHERALLY CLOGGED APERTURES

This is a continuation of application Ser. No. 98,315 filed Nov. 28, 1979, now abandoned.

The present invention relates to an electrophotographic sensitizing screen having a great number of apertures.

The electrophotographic sensitizing screen of this type is usually constructed at least with a mesh-like conductive member and a photoconductive layer superposed thereon as disclosed, for example, in U.S. Pat. Nos. 3,713,734 and 3,986,871, Japanese patent application Publication No. 30,320/70 and the like. As the mesh-like conductive member, there are usually used conductive meshes having a 50 to 300 mesh size, which are formed by calendering a woven article composed of metallic wires, or by electrofoaming, or by etching a metal plate with a thickness of 30 to 50μ.

In U.S. Pat. No. 3,713,734, there is disclosed a sensitizing screen of a four layer structure wherein a photosensitive layer is laminated on one surface of a conductive mesh, and an insulating layer and a conductive layer are successively laminated on another surface of the conductive mesh. In this case, a bias voltage may be applied between the conductive mesh and the conductive layer. Therefore, this sensitizing screen has such advantages that when the screen is uniformly charged by the application of the bias voltage, the charging velocity is accelerated the charged potential is held uniformly or may optionally be controlled and the like. Furthermore, when a copying latent image is formed on a dielectric recording member by modulating a corona ion flow in accordance with an electrostatic latent image formed on the screen, there are such advantages that the gradation and density of the image can be regulated and the image density may be made uniform if it is intended to obtain a great number of copied images from the electrostatic latent image once formed on the screen.

In such conventional sensitizing screens, however, the conductive mesh is formed in such a manner that a mesh angle or an array of apertures is parallel to each side of the sensitizing screen. While, the most part of graphic originals including halftone dot printed matters include a great number of lines parallel or perpendicular to each side of the sensitizing screen. Therefore, if it is intended to duplicate such graphic original, moire fringes are apt to occur in an ultimate copied image. Furthermore, when the conductive mesh is manufactured by the electrofoaming or etching process as mentioned above, most of the resulting meshes have such a cross section of each mesh portion between the adjoining apertures that upper and lower sides are substantially symmetrical with each other. As a result, if the insulating layer is formed on such conductive mesh by the conventional spraying process, the stream of the insulating material is disturbed at the circumference of each mesh portion constituting the mesh and hence the thickness of the insulating layer becomes uneven. Consequently, when the conductive layer is formed on such insulating layer and then the sensitizing screen is uniformly charged by the application of the given bias voltage, undesirable sparks are apt to be caused between the conductive mesh and the conductive layer, whereby a part of the conductive layer scatters and disappears.

Because, the occurrence of sparks results from the uniformity of the thickness of the insulating layer as well as the voltage withstanding characteristic of the insulating layer. As a result, undesirable band blurs are apt to be formed on the ultimate copied image and is not coincident with the graphic original.

Moreover, it is necessary to provide an electrode part for applying a given voltage to the conductive layer from an exterior. For this purpose, after the conductive layer is formed on the insulating layer in the form of thin film by a vacuum evaporation process or the like, a metal piece for the connection of lead wire is directly joined to the conductive layer. In this case, however, the connection between the metal piece and the conductive layer is broken off or becomes higher resistance, so that it is very difficult to obtain a good electrical connection. And also, a short circuit may be produced between the metal piece and the conductive layer in the formation of the electrode part.

In the formation of the conductive mesh, the etching process is preferably put into practice because the conductive mesh can cheaply be made from a metal plate in a higher accuracy. However, this etching process has such a drawback that an excessive etching is apt to be caused near the boundary between the outer peripheral portion of the metal plate serving as a frame and each of residual mesh portions defining the screen mesh, so that the mechanical strength of the mesh becomes insufficient.

It is, therefore, a main object of the present invention to provide an electrophotographic sensitizing screen which completely eliminates the above mentioned drawbacks of the prior art.

It is another object of the present invention to provide an electrophotographic sensitizing screen having a proper structure for preventing the occurrence of moire fringe.

It is a further object of the present invention to provide an electrophotographic sensitizing screen wherein sparks hardly occur between the conductive mesh and the conductive layer and hence defects due to the occurrence of sparks are not produced on an ultimate copied image.

It is a still further object of the present invention to provide an electrophotographic sensitizing screen having a proper structure wherein black band blurs incoincident with a graphic original are not produced on the copied image, particularly the peripheral part thereof.

It is another object of the present invention to provide an electrophotographic sensitizing screen which is properly constructed so as to apply a given bias voltage to the conductive layer from an exterior.

It is a further object of the present invention to provide an electrophotograhic sensitizing screen in which a sufficient mechanical strength is given to the vicinity of the boundary between the outer peripheral portion of the metal plate and each of residual mesh portions in the formation of the conductive mesh by the etching process.

A first aspect of the present invention lies in an electrophotographic sensitizing screen having a great number of apertures wherein at least insulating layer and conductive layer are successively formed on a conductive mesh, characterized in that the apertures of the conductive mesh are regularly arranged at such an angle as not to produce moire fringes with respect to a light image projected on the sensitizing screen.

In a second aspect of the present invention, the cross section of each of the mesh portions defining the conductive mesh is rendered a trapezoid in which one surface of all mesh portions is short side and the insulating layer is formed at a substantially uniform thickness on the short side of the trapezoid, whereby sparks being apt to be caused between the conductive mesh and the conductive layer can effectively be prevented.

In a third aspect of the present invention, apertures near to the outer peripheral portion of the mesh-like substrate after the formation of the insulating layer are clogged with an insulating material and the conductive layer is extended at least to such clogged aperture region, whereby corona ions passing through the outer peripheral portion are blocked so as not to produce undesirable band blurs incoincident with a graphic original on an outer peripheral portion of an ultimate copied image.

In a fourth aspect of the present invention, an electrode plate is disposed on a part of the conductive mesh substrate in an insulated state from the substrate and electrically connected to the conductive layer so as to apply a given bias voltage to the conductive layer through the electrode plate. As the electrode plate, a mesh-like electrode plate may also be used. Furthermore, the insulation between the substrate and the electrode plate may be accomplished with an insulative film.

In a fifth aspect of the present invention, after the electrode plate is disposed on a part of the conductive mesh substrate in an insulated state from the substrate, an adhesive layer is formed on the peripheral edge of the electrode plate, and then a metallic thin film is formed on the electrode plate and the adhesive layer by a vacuum evaporation process so as to electrically connect them to the conductive layer, and thereafter a conductive paint is applied on the metallic thin film so as to cover a region including the electrode plate and the boundary between the electrode plate and the adhesive layer, whereby a given voltage is applied to the conductive layer through the electrode plate and the metallic thin film. Preferably, the adhesive layer is the same material as used in the formation of the insulating layer.

In a sixth aspect of the present invention, the outer peripheral portion of the conductive mesh is clogged with an insulating material and an electrode plate is disposed at least on a part of the clogged aperture region in an insulated state from the mesh and electrically connected to the conductive layer.

In a seventh aspect of the present invention, when the conductive mesh is made from a metal thin sheet by the etching process, a great number of convex or concave portions each having a size larger than an aperture pitch of the mesh are formed near boundaries between the outer peripheral portion of the metal thin sheet serving as a frame and residual mesh portions constituting the mesh. By the formation of the convex or concave portion, the boundary line between the outer peripheral portion and the residual mesh portions is made longer and hence the contact area between the outer peripheral portion and the residual mesh portions becomes large and as a result, the mechanical strength near the boundary can be increased.

The present invention will now be described in greater detail with reference to the accompanying drawings, wherein:

FIGS. 1 and 3 are partly diagrammatic sectional views of the electrophotographic sensitizing screen constructed according to the present invention, respectively;

FIG. 2 is a plan view of an embodiment of a conductive mesh used in the manufacture of the electrophotographic sensitizing screen according to the present invention;

Figure 4A:
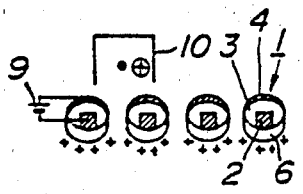
FIGS. 4A-4C are diagrammatic views at various electrophotographic processing steps using the sensitizing screen shown in FIG. 1, respectively.

In FIG. 1 is partly shown an embodiment of the electrophotographic sensitizing screen constructed according to the present invention. The sensitizing screen 1 comprises a conductive mesh 2, an insulating layer 3 and a conductive layer 4 successively superposed on one surface of the mesh 2, and a barrier layer 5, a photosensitive layer 6 and a surface layer 7 successively superposed on another surface of the mesh 2. As the conductive mesh 2, use may be made of ones formed by calendering a woven article composed of metallic wires, ones formed by electrofoaming, ones formed by etching a metal plate (thickness: 30–50$\mu$) in a mesh form and the like. In any case, the conductive mesh has a 50 to 300 mesh size in practice.

In FIG. 2 is shown an embodiment of the conductive mesh 2 used in the sensitizing screen 1 of FIG. 1. In this case, apertures of the mesh defined by the mesh portions **2*b* are regularly arranged at an angle $\theta$ inclined with respect to each side of an outer peripheral portion 2*a* serving as a frame. Such an inclination angle $\theta$ is set up to approximately 22°30′ with respect to a widthwise direction of the conductive mesh in FIG. 2**.

The reason why the inclination angle $\theta$ is limited to approximately 22°30′ is based on the experimental results as mentioned below. That is, the most of graphic originals to be copied include a great number of lines parallel or perpendicular to the conventionally used conductive mesh arranged parallel to each side of the mesh frame as previously described. Therefore, it has been confirmed that when the inclination angle $\theta$ is zero, if it is intended to duplicate such a graphic original, the definition of the lines in the original is lowered and moire fringes are caused. Now, in order to prevent the occurrence of moire fringe, the inclination angle $\theta$ should so be set that each mesh portion is far away from the lines of the original, i.e. the inclination angle $\theta$ should be 45° with respect to each side of the mesh frame. However, usual halftone dot printed matters are formed by means of a halftone screen having a screen angle of 45°. Therefore, when this halftone dot printed matter is duplicated by means of the sensitizing screen having a mesh inclination angle of 45°, the occurrence of moire fringe can not be prevented. Considering the above, in order to effectively duplicate the graphic original inclusive of the halftone dot printed matter without causing the moire fringe, it has been found that the inclination angle $\theta$ should be made approximately 22°30′ with respect to each side of the mesh frame.

Moreover, the inclination angle $\theta$ is acceptable to be within a range of 22°30′±10% in view of production error and original arrangement. Practically, the tolerance limit of the inclination angle is ±3~5% considering the case of accidentally arranging the original at a certain angle.

If the conductive mesh 2 is manufactured by the etching process, the mechanical strength of the boundary between the outer peripheral portion 2*a* and the mesh portion 2*b* is apt to become low as mentioned hereinbefore. Now, according to the present invention, when the conductive mesh 2 is made from a metal thin sheet with a thickness of 30 to 50μ by the etching process so as to leave the outer peripheral portion 2*a*, a great number of convex reinforcements 2*c* each having a width larger than the pitch of the aperture formed by etching are disposed at boundaries between the outer peripheral portion 2*a* and the mesh portions 2*b*. In this way, the contact area of the mesh portions 2*b* with the outer peripheral portion 2*a* is made large, whereby the mechanical strength of the boundary is increased. The height of the convex reinforcement 2*c* from the end of the outer peripheral portion 2*a* is sufficient to be approximately few millimeters for effectively performing its function. The formation of the convex reinforcements 2*c* can easily be achieved by baking a pattern corresponding to the final form of the conductive mesh shown in FIG. 2 on both surfaces of the metal thin sheet prior to the etching.

Referring to FIG. 2, a pair of supporting bars 8*a*, 8*b* are mounted on opposite ends of the outer peripheral portion 2*a*. These supporting bars 8*a*, 8*b* serve to hold the conductive mesh 2 in a step of manufacturing a sensitizing screen as mentioned below and to attach the finished sensitizing screen to a copying device in a form of drum or sheet. Moreover, the cross section of the supporting bars 8*a*, 8*b* may optionally be selected from circle, semi-circle, hollow-pipe, L-type and the like in compliance with use purpose.

FIG. 3 shows another embodiment of the electrophotographic sensitizing screen constructed according to the present invention. In this case, the cross section of the mesh portion between the adjoining apertures of the conductive mesh 2 is unsymmetrical in the upper and lower sides different from the case of FIG. 1, that is, the cross section is willfully rendered trapezoid.

For instance, when the conductive mesh 2 is made from a metal thin sheet with a thickness of 30 to 50μ by the etching process, the cross section of the mesh portion between the adjoining apertures can be rendered a substantially uniform trapezoid by baking a desirable pattern on both surfaces of the sheet and controlling the flow rate of the etching solution so as to more promote the etching from one surface of the sheet, or by changing the mesh size between the original patterns to be baked on both surfaces of the sheet, or by performing the etching only from one surface of the sheet. Moreover, in order to stably obtain a trapezoidal cross section over the whole of the conductive mesh, it has been experimentally confirmed that the etching condition be so established that an average value of the ratio of long side to short side in the trapezoid is not less than about 1.3. In this case, it is preferable that each sideline of the trapezoid is inclined at an angle of 10° to 30° with respect to a perpendicular line of the long side of the trapezoid.

Next, there will be described the manufacture of the electrophotographic sensitizing screen 1 having a cross sectional structure shown in FIG. 1 or FIG. 3 with the use of the conductive mesh 2 shown in FIG. 2 as a substrate.

An insulating layer 3 is first formed on the conductive mesh 2 (or the short side surface of the trapezoid in FIG. 3) by spraying a synthetic resin varnish. Any synthetic resins having a spraying ability can be used and among them, there are preferably used epoxy resin, polystyrene resin, polyurethane resin, silicone resin, polyvinyl chloride resin and the like. In order to uniformly spray the resin without clogging the apertures of the mesh, it is necessary to delicately control the concentration of the spraying solution, the spraying amount per unit time, the type of spray gun used, the spray pressure, the distance between the spray gun and the conductive mesh 2 and the like so as to achieve optimum spraying condition. For instance, when the conductive mesh 2 has a 200 mesh size, if it is intended to form the insulating layer having a thickness of about 30μ on the mesh by spraying without clogging the apertures, the spraying time usually takes several ten minutes to several hours though the time depends upon the kind of the synthetic resin used.

In the embodiment of FIG. 3, when the synthetic resin for the formation of the insulating layer 3 is sprayed on the conductive mesh 2 from the short side surface of the trapezoid in the same manner as described above, the sideline of the trapezoid becomes perpendicular to the spraying stream, so that the adhesion amount of the resin to the sideline becomes larger. As a result, the thickness of the insulating layer 3 becomes substantially equal from the sideline of the trapezoid to the short side thereof.

Then, a conductive layer 4 is formed on the insulating layer 3 by the vacuum evaporation of a metal and the like. As the material for the conductive layer, use may be made of any metals having a good evaporizability and stability, which include Al, Ag, Cu, In and the like. In case of using Al, the function of the conductive layer can sufficiently be accomplished by depositing Al layer with, for example, a thickness of 30 to 60 mμ. Moreover, the conductive layer 4 having a somewhat poor resistance to environment may effectively be used when the surface of the conductive layer is covered with a material used for the formation of a barrier layer 5 and/or a photosensitive layer 6 as mentioned below. Further, the durability of the conductive layer 4 can be increased by intentionally providing a thin insulating protect layer on the conductive layer or by further depositing a different metal or alloy on the conductive layer.

On another surface of the conductive mesh 2 opposite to the insulating layer (or the long side of the trapezoid in FIG. 3) is first formed a barrier layer 5, if necessary. The presence of the barrier layer 5 is particularly effective when Se or the like is used as a material for a photosensitive layer 6. The barrier layer is produced by depositing a metal on the conductive mesh and oxidizing it, or by providing an insulative thin film on the conductive mesh. In the latter case, various synthetic resin coatings as well as a vapor phase polymerized film of Parylene (trade name, made by Union Carbide Corporation) can be used as the insulative thin film. Moreover, the vapor phase polymerized film is formed over the circumference of the mesh assembly including the conductive mesh 2, the insulating layer 3 and the conductive layer 4, so that this film may also act as a protect film for the conductive layer 4. The thickness of the barrier layer is preferably within a range of several ten angstroms to several hundred angstroms. If the thickness exceeds the upper limit, there is a risk causing after-image.

On the barrier layer 5 is formed a photosensitive layer 6. In the formation of the photosensitive layer, use may be made of conventionally well-known photosensitive materials such as Se, CdS, ZnO and the like. For instance, the photosensitive layer of selenium with a thickness of 20 to 40 mμ can be formed by depositing on the mesh assembly in a vacuum evaporator in a time of about ten minutes to 1.5 hours while maintaining the temperature of the mesh assembly at about 50° to 65° C. In this case, it is desirable to control the temperature of the mesh assembly by indirectly heating the assembly with a radiant heat emitted from a temperature regulating plate, a nichrome heater or the like. Moreover, the care must be taken that a cover or a guide plate is properly disposed on the mesh assembly so as to prevent the clogging of apertures of the mesh with fine particles of Se falling away from an inner wall of the evaporator and a jig for supporting the mesh assembly during the vacuum evaporation. On the other hand, when CdS or ZnO is used as the material for the photosensitive layer 6, finely divided powder of CdS or ZnO is dispersed in an insulative synthetic resin varnish and then sprayed in the same manner as described in the formation of the insulating layer 3 to form the photosensitive layer 6.

Then, a surface layer 7 is superposed on the photosensitive layer 6 in order to improve a multiple copying characteristic. That is, the surface layer 7 serves for repeatedly forming a latent image copied on a dielectric recording layer without injuring the electrostatic latent image once formed on the sensitizing screen 1. Although the function of the surface layer is not understood in detail, the effect for improving the multiple copying characteristic is developed by providing a dielectric thin film layer (surface layer 7) on the photosensitive layer 6. For instance, when Se is the photosensitive layer 6, if the initial density of 1.10 is decreased to 0.95 by the multiple copying, the copying number is about 6 to 8 times in the absence of the surface layer 7, while the copying number is increased to about 25 to 30 times by forming the surface layer 7 of polyurethane or polymethylmethacrylate resin having a thickness of about 150 mμ on the Se photosensitive layer 6. The thickness of the surface layer 7 itself does not directly relate to the multiple copying characteristic but should be determined in view of the fact that the surface layer 7 effectively covers the photosensitive layer 6, that the function of the surface layer 7 is not lost even if harmful gas such as ozone and the like is invaded into the layer, and that the copied image is not adversely affected by charges stored on the surface layer 7. For this purpose, the thickness of the surface layer formed from the above mentioned resin is preferably within a range of several ten millimicrons to several hundred millimicrons.

The formation of an image using the sensitizing screen shown in FIG. 1 will be described below with reference to FIGS. 4A–4C. In this case, the barrier layer 5 and surface layer 7 are omitted for convenience' sake.

In FIG. 4A is shown an embodiment of the step of uniformly charging the charges on the sensitizing screen, wherein a bias supply source 9 is connected between the conductive mesh 2 and the conductive layer 4 and a given bias voltage is applied therebetween while a corona charger 10 uniformly charges the sensitizing screen 1. The polarity of corona charge is rendered positive in case of Se and the like as the photosensitive layer 6 and negative in case of CdS, ZnO, Se-PVK composite layer and the like as the photosensitive layer 6. The value of bias voltage, which is influenced by the voltage-withstanding characteristic between the conductive mesh 2 and the conductive layer 4, fairly depends upon the corona charging from the side of either the conductive layer 4 or the photosensitive layer 6. That is, when the corona charging is performed from the side of the conductive layer 4, it is practically desired to apply a bias voltage of 200 to 300 V because the photosensitive layer 6 is charged up to a voltage substantially equal to the applied bias voltage. On the other hand, when the corona charging is performed from the side of the photosensitive layer 6, it is sufficient to apply a bias voltage of 100 to 200 V because the photosensitive layer 6 is charged up to a voltage of 100 to 150 V higher than the applied bias voltage. The latter case is advantageous in view of the voltage-withstanding characteristic between the conductive mesh 2 and the conductive layer 4. The polarity of the bias voltage is the same as that of the corona charge on the photosensitive layer 6. The application of such bias voltage to the conductive layer 4 is to generate an electric field for effectively flowing corona ions until the charging on the photosensitive layer 6 is satisfactorily achieved, and is considerably good in the charged efficiency as compared with the case of charging a sensitizing screen having no conductive layer 4, so that it is very large in the practical value.

In the conventional sensitizing screen, the thickness of the insulating layer provided between the conductive mesh and the conductive layer is uneven due to the uniformity of the cross section of each mesh portion as mentioned hereinbefore, so that sparks are frequently caused at the uniform charging step of FIG. 4A. On the contrary, according to the present invention, the thickness of the insulating layer 3 particularly shown in FIG. 3 is uniform, so that sparks hardly occur at the step of applying the bias voltage and the uniform charging step.

Figure 4B:
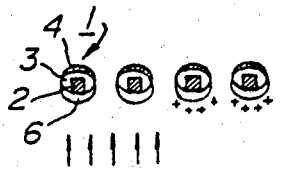

In FIG. 4B is shown an embodiment of the step of illuminating the charged sensitizing screen by a light image of a graphic original. This step is to form an electrostatic latent image corresponding to the light image on the sensitizing screen 1 by discharging the charges at regions corresponding to bright portions of the light image likewise the conventional zerography.

Figure 4C:
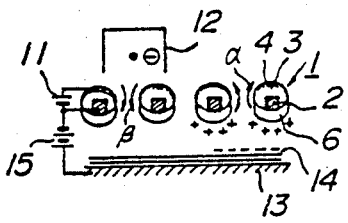

In FIG. 4C is shown an embodiment of the step of forming a copying latent image on a dielectric recording member. In this step, a bias supply source 11 is connected between the conductive mesh 2 and the conductive layer 4 and a bias voltage having the same polarity as and a value lower than that disclosed in the uniformly charging step of FIG. 4A is applied therebetween. A corona generator 12 giving charges of a polarity opposite to that of FIG. 4A is arranged at side of the conductive layer 4 of the sensitizing screen 1, while a conductive back plate 13 and a dielectric recording member 14 superposed thereon are arranged at side of the photosensitive layer 6 of the screen 1.

When the bias voltage is applied between the conductive mesh 2 and the conductive layer 4, an aperture region of the screen 1 corresponding to white parts of the graphic original (bright portions) forms an electric field $\beta$ blocking passage of negative corona ions through the apertures from the corona charger 12 because the charges on the photosensitive layer 6 corresponding to the bright portions are completely discharged in the step of FIG. 4B. While, an aperture region of the screen 1 corresponding to black parts of the graphic original (dark portions) forms an electric field $\alpha$ for passing the negative corona ions through the apertures because the dark portions have a surface potential close to the potential charged on the photosensitive layer 6 in the step of FIG. 4A though the ion blocking field is formed by the bias supply source 11.

A bias supply source 15 is connected between the conductive mesh 2 and the conductive back plate 13 so as to generate an electric field as high as 500 to 1,000 V/mm therebetween, whereby the corona ions passing through the apertures of the screen 1 are effectively guided on the recording member 14 without diffusion. In this way, the graphic original is copied on the recording member through the electrostatic latent image once formed on the sensitizing screen.

In the step of forming the copying latent image as shown in FIG. 4C, there is no charge in the electrostatic latent image once formed on the sensitizing screen because the corona ions directing toward the bright portions of the electrostatic latent image, which correspond to white parts of the graphic original, are cycled to a corona supply source (not shown) through the conductive layer 4 and the bias supply source 11 without passing through the apertures of the screen 1, while the corona ions directing toward the dark portions of the electrostatic latent image, which correspond to black parts of the graphic original, are projected to the recording member 14 through the apertures of the screen 1. Therefore, it makes possible to obtain a great number of copies from the electrostatic latent image once formed on the sensitizing screen by repeatedly renewing only the recording member. In this multiple copying, however, the copying number is limited by a dark decay of the photosensitive layer 6 and a tendency that a part of corona ions passed through the apertures of the screen 1 corresponding to the dark portions directs toward the side of the photosensitive layer 6 so as to decrease the potential of the electrostatic latent image formed on the screen in the step of FIG. 4C. The influence of the darkdecay and the undesired corona ion behavior can be considerably mitigated by varying the value of bias voltage applied between the conductive mesh 2 and the conductive layer 4 in accordance with the change of the potential of the electrostatic latent image on the photosensitive layer 6 or the aimed copying number at the step of FIG. 4C as proposed before this time.

Then, the copying latent image on the recording member is visualized with a toner having a charge of a polarity opposite to that of the charge of the latent image and fixed to produce an ultimate copied image.

As mentioned above, according to the present invention, the inclination angle of each mesh portion is set to an angle hardly producing moire fringe, so that the occurrence of moire fringe can effectively be prevented even when duplicating a graphic original such as halftone dot printed matter and the like. Furthermore, the mechanical strength near the boundaries between the outer peripheral portion of the metal thin sheet and residual mesh portions after the etching is increased by providing a great number of convex or concave portions on these boundaries, so that there is no damage on the boundary when the sensitizing screen is uniformly extended in a flat or drum shape. As a result, the life of the screen becomes long, so that the formation of this screen by the etching process is advantageous in economy.

In the electrophotographic sensitizing screen of FIG. 3, the cross section of each mesh portion between the adjoining apertures is substantially a trapezoid and the insulating layer and the conductive layer are successively formed on the short side of the trapezoid, so that the thickness of the insulating layer can be made uniform and consequently sparks caused between the conductive mesh and the conductive layer can effectively be prevented. For instance, when a conductive mesh having a 200 mesh size is made from a metal thin sheet having a thickness of 30 to 50$\mu$, the etching has hitherto been practiced from both sides of the sheet after desired patterns are baked on both sides of the sheet. In this case, however, it is difficult to strictly control the etching rate on both sides at constant, so that the resulting conductive mesh includes various cross-sectional shapes such as a trapezoid shown in FIG. 3, a trapezoid opposite to that of FIG. 3, a rectangle and the like and consequently sparks are apt to be caused because the thickness of the insulating layer formed on the conductive mesh becomes partially uneven. On the contrary, according to the present invention, the cross section of each mesh portion is intentionally rendered a trapezoid shown in FIG. 3 as a whole by positively changing the etching rate on both sides of the sheet and the like without forming at least a trapezoid opposite to that of FIG. 3. Therefore, the occurrence of sparks can be prevented as far as possible in the electrophotographic sensitizing screen of FIG. 3. As a result, a defect due to the occurrence of spark hardly appears in the ultimate copied image even after the multiple copying and also the life of the screen is more prolonged, so that the formation of the conductive mesh with a trapezoid shape is very advantageous in economy.

Next, there will be described a problem caused by spraying a synthetic resin solution as an insulating material in case of forming the insulating layer 3 on the conductive mesh 2 of the sensitizing screen 1 shown in FIG. 1 and a means for solving such problem.

For instance, when the insulating layer 3 having a thickness of 30$\mu$ is formed on the conductive mesh 2 having a 200 mesh size, if the aperture of the conductive mesh 2 is 100$\mu$, the size of the aperture becomes about 40$\mu$ at the end of the spraying. From this fact, it is understood that in order to obtain the aforementioned small apertures without clogging in the spraying, it is necessary to apply the very small amount of the resin on the mesh over a long period. Moreover, it is desirable to cover the conductive mesh 2 with the insulating layer 3 at a substantially uniform thickness as sectionally shown in FIG. 1. However, if the thickness of the insulating layer 3 becomes partly uneven over the whole of the screen 1, sparks are apt to be caused at that uneven portion or there is a fear that the modulating characteristic of the screen (see FIG. 4C) varies at that uneven portion so as to produce an unevenness in the copying latent image. Particularly, such unevenness of the insulating layer 3 comes into questions in a region of 3 to 10 mm extending inwardly from the boundary between the conductive mesh 2 and the outer peripheral portion 2*a* (see FIG. 2) because air stream in the spraying considerably varies at such region and hence the amount of the resin adhered to that respective mesh portions decreases. In this case, if a given bias voltage is applied to the conductive layer 4 formed on such insulating layer 3, sparks are caused due to the deficiency of the voltage-withstanding characterstic, whereby a short circuit is produced between the conductive mesh 2 and the conductive layer 4.

In order to prevent such occurrence of sparks, it is better to form the conductive layer 4 in such a region of the conductive mesh as to exclude an area of 5 to 10 mm extending inwardly from the boundary between the mesh portions and the outer peripheral portion (*2a*). However, by such formation of the conductive layer the size of the screen is made larger with respect to an effective image plane, which is unfavorable in view of the construction of the apparatus. Further, when the effective image plane is completely coincident with the region of the conductive layer 4, if the recording member slides widthwisely during the feeding, a part of the recording member comes off from the region of the conductive layer 4. As a result, that part of the recording member is not subjected to the action of the conductive layer 4 blocking the passage of corona ion flow and receives the corona ions, so that a black image is finally formed on that part of the recording member in a band shape.

Figure 5:
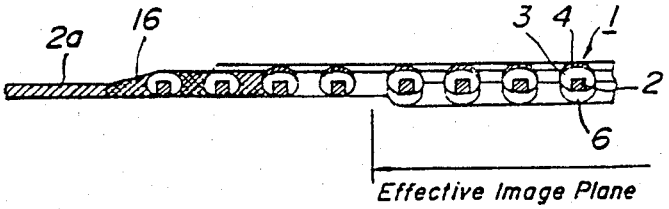
FIG. 5 is a partly diagrammatic sectional view of an embodiment showing a structure of an outer peripheral portion of the sensitizing screen shown in FIG. 1.

According to the present invention, in order to eliminate the formation of the above described undesirable image, after the insulating layer 3 is formed on the conductive mesh 2, apertures existent in an area of 3 to 10 mm extending inwardly from the boundary between the mesh portions and the outer peripheral portion *2a* are clogged with an insulative resin 16 as shown in FIG. 5, whereby the passage of the corona ions is completely blocked at that clogged aperture region. Then, when the conductive layer 4 is formed on the insulating layer 3, the region of the conductive layer 4 is extended at least to the clogged aperture region.

When the photosensitive layer 6 is formed on the conductive mesh 2, it is convenient to determine the region of the photosensitive layer 6 as follows. That is, since the photosensitive layer 6 serves to form an electric field for accelerating the passage of corona ion for the formation of the copying latent image, if the region of the photosensitive layer 6 is, for example, larger than the effective image plane, a part of the photosensitive layer 6 beyond the effective image plane is not exposed. Therefore, if the recording member is partly existent in that part of the photosensitive layer, undesirable black image is also produced on that part of the recording member. The cause of such phenomenon results from the cases that the recording member is slid widthwisely during the feeding and that the fixing positions of the platform, the sensitizing screen and the like are different from the design positions. For this reason, there is a risk of forming the aforementioned black image even if the working error and assembling error are usually within an acceptable range. In order to prevent the occurrence of this risk, the region of the photosensitive layer 6 is rendered substantially equal to the effective image plane as shown in FIG. 5 or may be set to such an extent that only the working and assembling errors are subtracted from the effective image plane.

As mentioned above, according to the present invention, the apertures in the peripheral portion of the sensitizing screen are clogged with the insulative resin and the conductive layer is extended at least to such clogged aperture region, so that sparks are not caused between the conductive layer and the conductive mesh in such peripheral portion. Further, this peripheral portion does not pass the corona ion, so that undesirable band-like image corresponding not to a graphic original is not developed on the copied image.

There will be described the formation of an electrode part for applying a given bias voltage to the conductive layer 4 of the sensitizing screen 1 shown in FIG. 1 from an exterior.

In the formation of the electrode part, there are two problems, i.e. a problem accompanied with the case of forming the conductive layer 4 by the vacuum evaporation process as described above, and a problem producing a short circuit between an electrode plate and the conductive mesh 2. That is, the former case is due to the fact that a part of the conductive layer 4 is disconnected to lose the electrical continuity when subjecting to a mechanical bending or a thermal deformation, while the latter case is caused when the electrode plate comes into contact with the conductive mesh 2.

Figure 6:
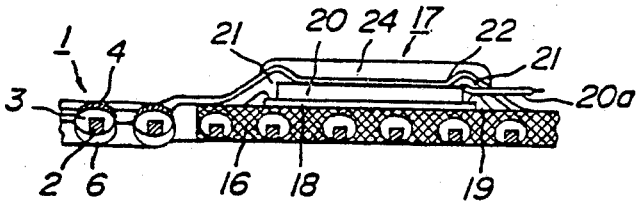
FIGS. 6 and 7 are partly diagrammatic sectional views showing various embodiments of an electrode part provided on the sensitizing screen shown in FIG. 1, respectively.

In FIG. 6 is shown an embodiment of the electrode part according to the present invention. The formation of the electrode part 17 may be carried out before or after the formation of the insulating layer 3 in the sensitizing screen 1. In the embodiment of FIG. 6, the electrode part 7 is formed after the formation of the insulating layer 3. First, an insulative synthetic resin solution for an aperture clogging member 16 is poured into apertures of a mesh-like substrate composed of the conductive mesh 2 and the insulating layer 3 corresponding at least to a region providing an electrode part or over the outer peripheral portion of the mesh and then solidified therein. Next, an insulative film 18 is placed on the thus clogged aperture region at side of the insulating layer 3. As the insulative film 18, use may be made of various synthetic resin films such as Myler (trade name) and the like, insulative papers and so on. The insulative film 18 is secured by a synthetic resin layer 19 formed by solidifying the same synthetic resin solution as used in the aperture clogging member 16 at the peripheral edge of the insulative film 18. On the insulative film 18 is placed an electrode plate 20, each side of which being smaller by 1 mm than that of the insulating film 18. Moreover, it makes possible to previously provide a lead wire 20a on the electrode plate 20.

Then, an adhesive layer 21 made of a synthetic resin solution is applied on the outer peripheral edge of the electrode plate 20 so as to firmly secure the electrode plate 20 and the insulative film 18 to the clogged aperture region of the substrate. In this case, it is effective that the adhesive layer 21 is the same material as used in the formation of the insulating layer 3. Particularly, it is necessary to gently slope the adhesive layer 21 near the boundary between the adhesive layer and the substrate. For instance, if the inclination angle of the adhesive layer 21 is large at such boundary, a metallic thin film formed on the adhesive layer 21 and the electrode plate 20 at subsequent step becomes thin and is liable to be disconnected.

Figure 7:
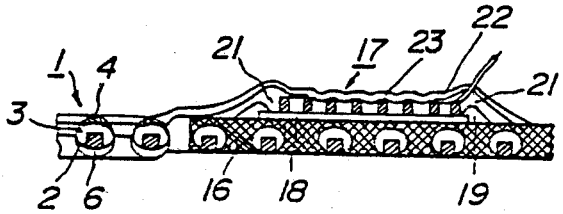

After the formation of the adhesive layer 21, a metallic thin film 22 is formed by the vacuum evaporation process. In this embodiment, the metallic thin film 22 is deposited throughout the mesh-like substrate inclusive of the electrode plate 20. In this way, the conductive layer 4 is uniformly formed from the mesh portions to the electrode plate 20. However, the metallic thin film 22 (or the conductive layer 4) is apt to be disconnected in the vicinity of the boundary between the electrode plate 20 and the adhesive layer 21 due to deformation caused by the difference of thermal expansion coefficient between the electrode plate 20 and the adhesive layer 21. In order to prevent such disconnection, there may be taken the following two ways, i.e. a first way is the use of mesh-like electrode plate 23 as shown in FIG. 7 so as to increase the bonding force to the adhesive layer 21 and a second way is the use of a conductive paint 24 applied on the metallic thin film 22 so as to cover a region including the electrode plate and the boundary between the electrode plate 20 and the adhesive layer 21 as shown in FIG. 6, which is applicable to the electrode part 17 shown in FIG. 7. In the second way, even if the metallic thin film 22 or the conductive layer 4 is disconnected near the boundary between the electrode plate 20 (or 23) and the adhesive layer 21, the continuity between the electrode plate 20 (or 23) and the conductive layer 4 is effectively held with the conductive paint 24.

Figure 8:
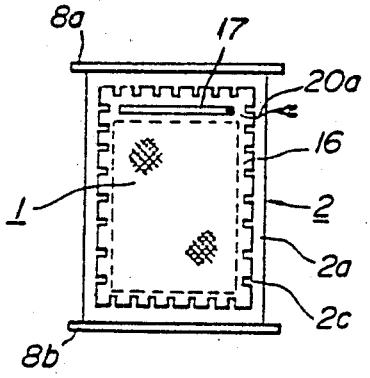
FIG. 8 is a plan view of the sensitizing screen shown in FIG. 1.

The electrode part 17 shown in FIG. 6 or 7 is formed on the sensitizing screen 1 so as to extend toward the widthwise direction of the screen as shown in FIG. 8. When the copying is repeated at 30,000 times with the use of the sensitizing screen shown in FIG. 8, there is observed no change on the function of the electrode part. On the contrary, when using the sensitizing screen provided with the electrode part shown in FIG. 6 except the conductive paint 24 in the multiple copying, the electric resistance between the electrode plate 20 and the conductive layer 4 gradually increases during the copying of several thousand times and finally the electrical continuity between the electrode plate 20 and the conductive layer 4 is disconnected and hence the required bias voltage cannot be applied to the conductive layer 4. Moreover, if the sensitizing screen is manufactured according to the embodiment of FIG. 6 or 7 without inserting the insulative film 18 between the electrode plate 20 or 23 and the conductive mesh 2, the most part of the obtained sensitizing screens have a short circuit between the electrode plate 20 or 23 and the conductive mesh or produce a short circuit during the application of the given bias voltage.

In the embodiments of FIGS. 6 and 7, the electrode part 17 is arranged on the clogged aperture region of the conductive mesh 2. Aside from, the electrode part may be arranged on a part or a side of the outer peripheral portion 2*a* of the conductive mesh 2 as shown in FIG. 8. In the latter case, it is not necessary to clog the apertures of the conductive mesh with an insulating material. Moreover, the insulative film 18 is not always secured with the synthetic resin layer 19 because the insulative film 18 and the electrode plate 20 superposed thereon may be secured with the adhesive layer 21 as one body.

Although several embodiments of the present invention have been shown and described, it will be obvious that other adaptations and modifications can be made without departing from the scope of the present invention.

What is claimed is:

1. An electrophotographic sensitizing screen formed from a conductive mesh having a plurality of apertures therein extending over the surface and to the peripheral edges thereof in a regular array, said mesh including an insulating layer applied thereto, a conductive layer overlying said insulating layer, and a photosensitive layer overlying said conductive layer the improvement comprising clogged apertures extending inwardly of the peripheral edges of said screen to define a peripheral area, said apertures in said peripheral area clogged with an insulative synthetic resin to block the passage of corona ions therethrough, said area of said screen interiorly of said peripheral area serving as an image area, said conductive layer extending over said image area at least to said peripheral area.

2. An electrophotographic sensitizing screen as claimed in claim 1, wherein: said insulative synthetic resin for clogging is the same as that used in the formation of said insulating layer.

3. The electrophotographic sensitizing screen of claim 1 wherein the array of apertures in said mesh are regularly arranged at an oblique angle relative to the peripheral edges of said screen.

4. The electrophotographic sensitizing screen of claim 3 wherein the oblique angle at which said apertures are arranged is approximately 22° 30′ relative to the widthwise direction of said screen.

5. The electrophotographic sensitizing screen of claim 1 wherein said peripheral area extends inwardly of said peripheral edges for a distance of from about 3 mm. to about 10 mm.

6. An electrophotographic sensitizing screen being provided with at least an insulating layer and a conductive layer successively formed on a conductive mesh including mesh portions defining an effective image area with a surrounding outer peripheral mesh portion as a frame, and a photosensitive layer formed on said conductive mesh opposite said insulating layer within said effective image area, said screen including a plurality of apertures therein, the improvement comprising said apertures in an area from about 3 mm. to about 10 mm. inwardly of the boundary between said mesh portions and said outer peripheral portion being clogged with an insulative synthetic resin after the formation of said insulating layer, and said conductive layer is formed on said insulating layer to extend at least to such clogged aperture region.

* * * * *